US006638107B1

(12) United States Patent
Silfverberg

(10) Patent No.: US 6,638,107 B1
(45) Date of Patent: Oct. 28, 2003

(54) CABLE COUPLING DEVICE

(75) Inventor: Kim Silfverberg, Stockholm (SE)

(73) Assignee: Watercap AB, Stockholm (SE)

( * ) Notice: Subject to any disclaimer, the term of this patent is extended or adjusted under 35 U.S.C. 154(b) by 0 days.

(21) Appl. No.: 10/089,093

(22) PCT Filed: Oct. 19, 2000

(86) PCT No.: PCT/SE00/02024

§ 371 (c)(1),
(2), (4) Date: Apr. 12, 2002

(87) PCT Pub. No.: WO01/29932

PCT Pub. Date: Apr. 26, 2001

(30) Foreign Application Priority Data

Oct. 21, 1999 (SE) ..... 9903800

(51) Int. Cl.[7] ..... H01R 13/40
(52) U.S. Cl. ..... 439/587; 439/275
(58) Field of Search ..... 439/587, 588, 439/589, 274, 275, 750

(56) References Cited

U.S. PATENT DOCUMENTS 3,085,138 A * 4/1963 Brown et al. ..... 439/750
4,269,472 A 5/1981 Shaffer et al. ..... 339/223 R
5,017,160 A * 5/1991 Garcia ..... 439/750
5,035,638 A * 7/1991 Kourimsky ..... 439/275
5,278,354 A 1/1994 Lhomme ..... 174/84 R
5,364,285 A 11/1994 Sakurai ..... 439/275
5,401,184 A 3/1995 Sundstrom et al. ..... 439/367
5,532,433 A 7/1996 Endo et al. ..... 174/84 C
5,564,946 A 10/1996 Kodama ..... 439/587

FOREIGN PATENT DOCUMENTS

EP 0 633 626 1/1995
WO 97/37402 10/1997

* cited by examiner

*Primary Examiner*—Ross Gushi
(74) *Attorney, Agent, or Firm*—Jacobson Holman PLLC

(57) ABSTRACT

A cable coupling device which includes a coupling body (22) that has a through passing passageway (21) for receiving an associated end of a cable (1). The body carries a cup-shaped electric contact whose edge forms a crimping ring that tightly surrounds a body part (23) of reduced diameter. A bared conductor element (11) is placed between the electric contact and the body part (23). The crimping ring compresses the body (22) so as to seal the wall of the passageway against the cable sheath. A scaling sleeve (50) can bridge two bodies (22) which are each connected to a cable (1) and are conductively coupled via respective electric contacts. The sleeve (50) therewith provides a sealed enclosure of the mutually coupled parts of the cables in a region delimited by the sleeve and the bodies (22).

12 Claims, 3 Drawing Sheets

CABLE COUPLING DEVICE

This is a nationalization of PCT/SE00/02024 filed Oct. 19, 2000 and published in English.

BACKGROUND OF THE INVENTION

1. Field of the Invention

The invention relates to a cable coupling device that includes a body having a through-passing, cable-receiving passageway for receiving a sheathed conductor.

2. Description of the Related Art

A coupling location between one end of a cable and an associated connector is vulnerable in several respects, although perhaps primarily because the cable conductors can become exposed and corrode in an aggressive environment, so as to impair or break the electric connection between cable and connector.

There is a danger that water and gas will penetrate axially into the cable ends between the cable sheath and the conductor or conductors embraced by the sheath. When the conductor comprises a sheathed wire or its technical equivalent, ambient gases and liquids will, of course, be able to penetrate axially between the sheath and the wire. When the sheathed conductor, is comprised of a bundle of wires, gas and liquid will, of course, also be able to penetrate axially in between the wires and cause corrosion in the cable interior.

The vulnerability of the coupling location will, of course, also depend on the prevailing environment; couplings in an outdoor environment on land or on water are particularly vulnerable.

Although it is known to sealingly enclose the entire coupling location between cable end and connector, these known solutions are complex, expensive and difficult to establish, besides being troublesome.

SUMMARY OF THE INVENTION

One object of the invention is to provide a favourable connection between a cable conductor and a coupling means.

Accordingly, a further object of the invention is to provide a device that enables safe electric connections to be achieved and reliable encapsulation of the coupling region between a cable end and a coupling to be achieved with the aid of a simple structure that can be produced at low cost and that is easy to fit.

This object is achieved with the device having a body with a through-passing, cable-receiving passageway therein for receiving a cable, an electric contact having a passageway-part and a generally cup-shaped part fitted over an end section of the body such that the passageway opens into the generally cup-shaped part. The passageway-part, which also opens into the generally cup-shaped part for receiving the conductor of the cable and for being conductively connected thereto, is surrounded by a thick-wall part for crimping an inner wall of the passageway-part against the conductor. The body section is made of a resilient material at least in a crimping region thereof such that sealingly crimping the cup-shaped part of the electric contact around the body section causes a wall of the passageway to seal against an outer periphery of a cable inserted therein to prevent moisture from entering an interior of the cup-shaped part.

Further embodiments of the device will be apparent from the accompanying dependent claims.

The invention is based on the concept of threading respective cable end-parts through a coupling body which has a channel or passageway that corresponds to the cable, and connecting electrically to the connector an exposed end of an electric conductor provided in the cable. The body is comprised of a resilient elastic material. The coupling device has a generally cupped end-part which receives the cable-end and which is crimped such that the body will sealingly clamp around and against the sheath of the conductor radially inwards of the crimp. The crimping force is transmitted so as to press the sheath against the conductor wire and seal around its circumference. When the conductor includes a wire bundle, the crimp may also be caused to compact the wire bundle so as to make axial leakage therethrough difficult.

The crimping sleeve forms a sealing hat that is applied to the body and sealingly screens the channel outlet end and also sealingly encloses said cable-end and the exposed end of the conductor wire, said end being brought into electrically conductive contact with the crimping sleeve by crimping. The crimping sleeve may form a male electric contact or may be provided with a female electric contact.

The body may include two or more channels that each receive a single cable and which extend centrally through a resilient elastic body on which a generally cup-shaped crimping sleeve can be sealingly fitted. Moreover, a sealing sleeve may be provided whose internal circumference is able to sealingly connect with the outer circumferential surface of two mutually co-acting bodies, and sealingly bridge said bodies.

BRIEF DESCRIPTION OF THE DRAWINGS

The invention will now be described by way of example and with reference to the accompanying drawings, in which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
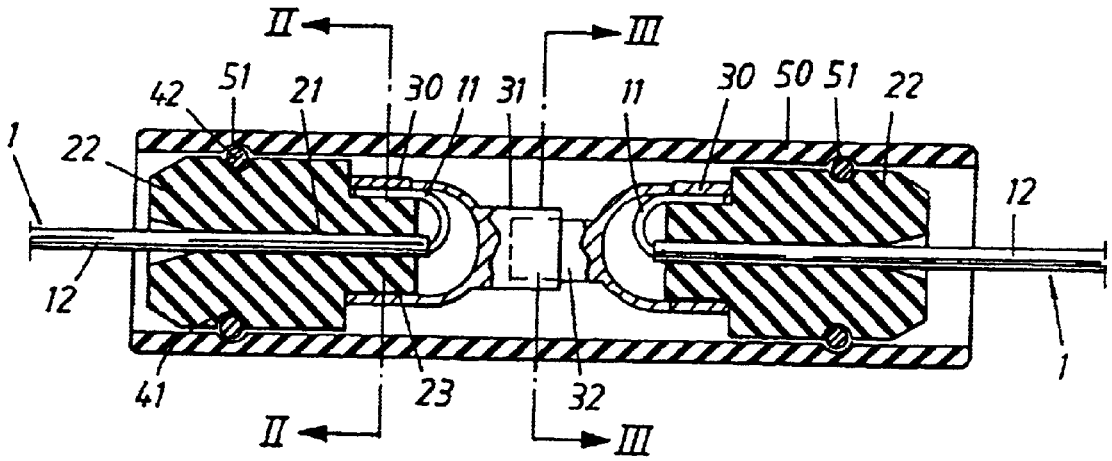
FIG. 1 is a schematic axial sectioned view of an inventive coupling device.
Figure 2:
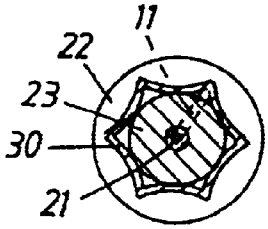
FIG. 2 is a cross-sectional view taken on the line II—II in FIG. 1.
Figure 3:
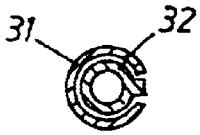
FIG. 3 is a cross-sectional view taken on the line III—III in FIG. 1.

FIGS. 1–3 illustrate a device for electrically coupling together two cables 1. For the sake of simplicity, each cable 1 can be assumed to consist of a wire 11 or its technical equivalent which is covered tightly by a sheath 12 to form a sheathed conductor 11, 12. The end-part of the cable 1 extends through a central passageway 21 in a rotationally symmetrical body 22 that has a reduced diameter at one end-part 23. The sheath 12 has been stripped from the end of the wire 11 and this bare end of the wire is folded back against the outside of the body part 23. A crimping ring 30 is fitted around the body part 23 and over the wire 11, and is crimped so that the part 23, which is comprised of deformable material, is sealingly clamped against and fully around the sheath 12. Because the sheath is yieldable, crimping will also result in tight, sealing contact between the inner surface of the sheath 12 and the wire 11. In the event of the sheathed conductor 11, 12 being comprised of a wire bundle, the wires in said bundle will also be compressed radially. As a result, the passageway 21 will be sealingly screened through contact with the outer surface of the sheath 12. The end-part of the cable is compressed in the region of the part 23 such as to essentially prevent the passage of fluid axially through the interior of the cable. The crimp is spaced from the end of the part 23. The crimping ring 30 preferably forms a peripheral part of a cup-shaped element (cf. FIG. 6) that encloses the exposed end of the wire or the like connected to the inside of said element. The contact location between the sheathed conductor and partly the wedge-shaped element is screened by the body 23 and said element and the sealing means established by the crimping procedure, partly around the outer periphery of the body 23 against the crimping ring, and partly around the circumference of the sheath 12 against the wall 21 of the passageway and the wire 11 respectively.

FIG. 1 shows the crimping ring 30 of one body connected to a female contact element 31 that is shown to receive axially a male contact element 32 which is connected to the crimping ring 30 on the other body 22.

Each body 22 includes a peripheral or circumferential groove 41 that accommodates an O-ring 42, and a sealing sleeve 50 bridges the two O-rings 42 and seals there-against. In order to ensure that an axial barrier effect is achieved, the sleeve 50 may be provided with ring-shaped grooves 51 that receive the O-rings 42. The ends of the sleeve may have internal bevels, and the passageways 21 may also include lead-in bevels to facilitate threading of the cables 12 there-through.

As will be evident from FIG. 2, the coupling device may be used for a cable 1 that includes a single sheathed conductor, in other words a wire 11 covered by a sheath 12. As will be apparent from FIG. 3, the male contact element 32 and the female contact element 31 may be resilient radially with a certain degree of conformity such as to establish an effective electric connection. The male contact element 32 and the female contact element 31 may be designed to take a determined position of rotation relative to each other when establishing the connection.

Figure 4:
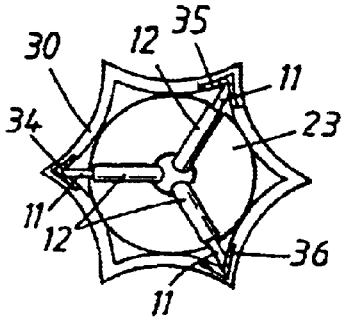
FIG. 4 is a cross-section view corresponding to FIG. 2 but taken through a variant of the inventive device.
Figure 5:
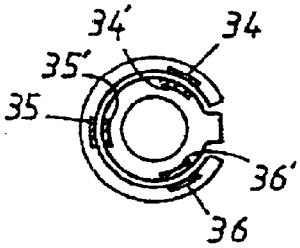
FIG. 5 is a cross-sectional view corresponding to FIG. 3, but taken through a variant according to FIG. 4.

As will be evident from FIG. 2, the body 22 is radially compacted by the crimping ring such that the sheathed wire 11 will obtain good electric contact with the crimping ring 30 and so that the wall of the passageway 21 will be in sealing contact with the sheath 12 around the whole of its perimeter, thereby preventing fluid leakage axially through the passageway 21. In one variant, the cable 1 may include several conductors, as shown in FIG. 4, wherein the wires 11 in the sheathed conductors are placed in pre-determined positions around the periphery, or perimeter, of the part 23 such as to be brought into contact with respective conductive parts 34, 35, 36 of the crimping ring 30. Because the male contact element 32 and the female contact element 31 have determined positions of rotation in relation to one another, the electrically conductive parts 34, 35, 36 of the female contact element 31 can be brought into conductive contact with corresponding parts 34', 35' and 36' on the male contact element 32.

Figure 6:
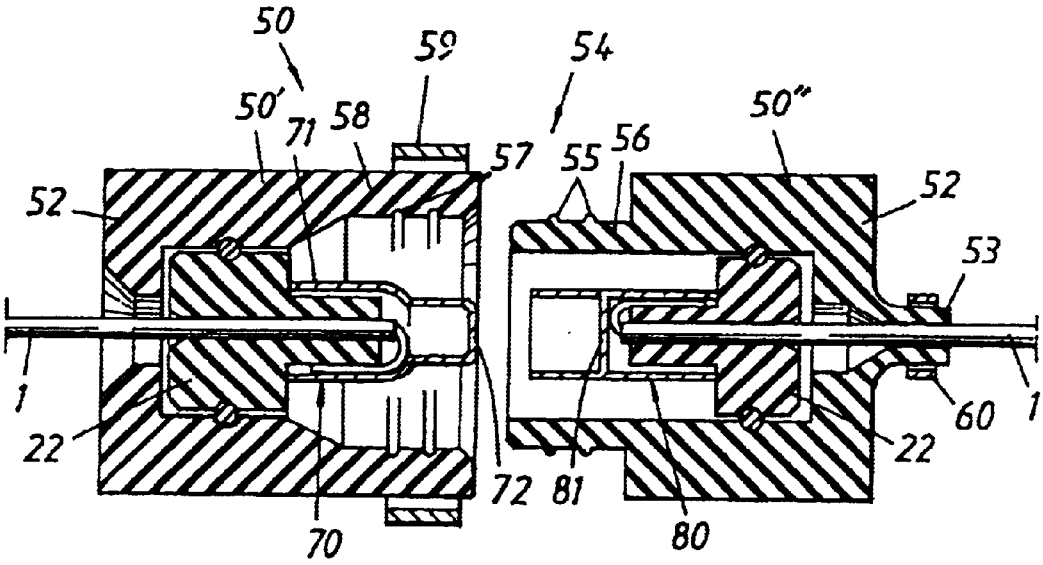
FIG. 6 is an axial sectional view of a further embodiment of the coupling device.

In a further development of the invention, FIG. 6, the crimping ring with the male contact may be formed by a dish-shaped metallic element 70 whose edge part 71 forms the correspondence to the crimping ring 30 and whose bottom part 72 corresponds to the male contact 32. Due to said crimping action, the element 70 can tightly embrace the body part 23 while enclosing the end of the cable and screening its passageway 21. As shown, the other body part 23 includes a tubular element 80 which is also comprised of electrically conductive material. The element 80 has an inner partition wall 81 that forms two oppositely directed basin-shaped cavities, of which one embraces the body part 23 and its edge part forms a correspondence to the crimping ring 30 and can be brought sealingly around the body part 23 while enclosing said end of the cable and screening the passageway 21. The other basin-shaped cavity of the element 80 corresponds to the female contact 31.

As will be seen from FIG. 6, the sleeve 50 can include two longitudinally extending tubular sections 50', 50" that can be mutually end-jointed with an overlap joint 54 that includes sealing means and means for holding the sections together, for instance means in the form of circumferentially extending beads 55 on one joint lip 56 and corresponding grooves 57 on the other joint lip 58. The overlap joint may optionally be strengthened with a crimping ring 59 which may be made of metal or heat shrinkable plastic.

The ends of the tubular sections 50', 50" may carry ring flanges 52 that extend over the ends of the bodies 22, said overlap join 54 making it difficult to pull the electrical contacts 31, 32 apart unintentionally.

The ring flanges 52 may be replaced with or extended with a tubular element 53 that extends away from the sleeve and surrounds the cable 1 with a small clearance. When the tubular element 53 is comprised of yieldable material, it can be sealingly clamped around the cable, for instance with the aid of a surrounding crimping ring 60, for instance made of metal for mechanical crimping, or by shrinking the tubular element 53 when said element is (heat)shrinkable.

Figure 7:
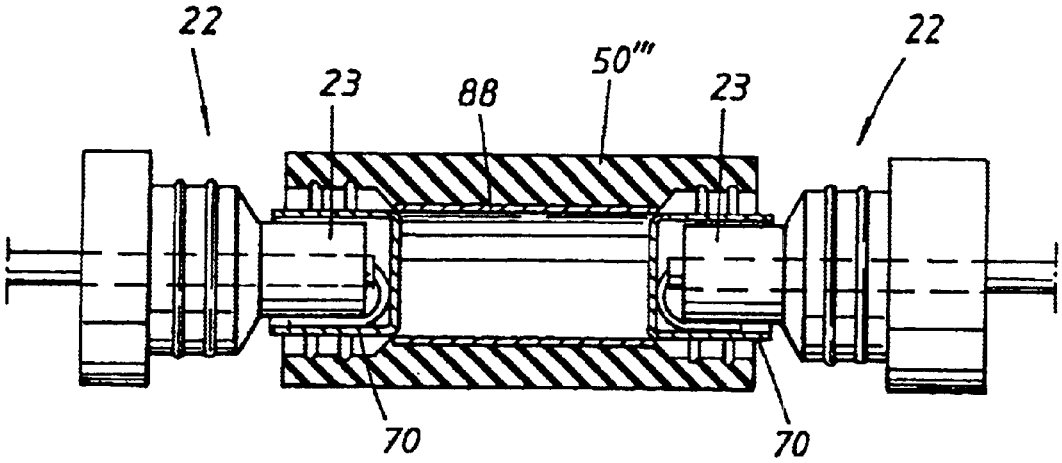
FIG. 7 illustrates a variant of the coupling device shown in FIG. 6.

In a further variant of the invention shown in FIG. 7, the bodies 22 with associated crimping rings and electrical contacts may be mutually similar, in principle as shown to the left in FIG. 6, wherein the sleeve 50'" has at both ends an internal shape that is complementary to the shape of the perimeter of the bodies 23, so as to seal against the bodies. The sleeve 50'" has on its inside a tubular conductor 88 that receives the elements 70.

In the embodiments illustrated in FIGS. 1 and 6, the cable includes one single wire 11 covered by a sheath 12, and a body part 23 which is coaxial with the body 23. It will be understood, however, that the cable 1 may contain several sheathed conductors that each include a wire 11 or some technical equivalent which can be held by a sheath 12, wherein each of the sheathed conductors 11, 12 extends through an associated passageway 21 and out through a body part 23 on which a basin-shaped or cup-shaped element 70, 80 has been crimped, as illustrated in FIG. 6.

Figure 8:
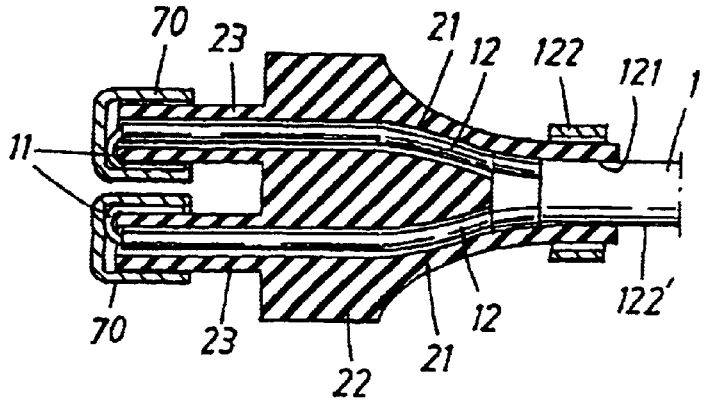
FIG. 8 illustrates a further embodiment of the coupling device.

As shown in FIG. 8, the invention can be applied in respect of a coupling that includes a body 22 which has at one end a larger passageway 121 that receives a cable 1. The cable may have a surrounding sheath which can be crimped sealingly against the wall of the passageway 121 with the aid of an external crimping ring 122 surrounding the body. As will be evident from FIG. 8, the cable includes two sheathed conductors 11, 12 each of which extends through a respective passageway and out through a respective associated part 23. The conductors are embraced at the end of said part 23 by a generally cup-shaped crimping sleeve 70 whose edge part is crimped on the sheathed conductor 11, 12 so as to establish ring seals directly against the outer periphery of the part 23 on the one hand, and between the wall of the passageway and the wire or like conductor 11 on the other hand, as described above. The surrounding casing 122 establishes a circumferential seal between the cable sheathing and the wall of the passageway 121.

FIG. 8 shows the parts 23 extending parallel from a body 22 such as to form an electrical contact element of the kind that can be used in a conventional 220 V outlet, wherein the cable 1 has a sheath which contains two sheathed conductors, the sheaths of which are referenced 12.

Figure 9:
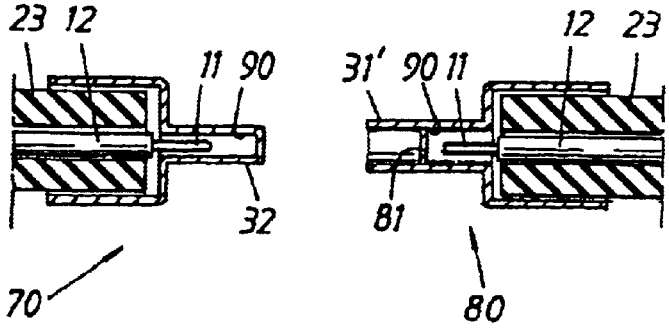
FIG. 9 illustrates a variant of the electrical contacts.

FIG. 9 illustrates a variant of the electrical contacts 70, 80. The difference between the FIG. 9 embodiment and the FIG. 6 embodiment is that in the FIG. 9 embodiment the end of the wire 11 is not bent back against the body 23, but extends straight forwards (which may be necessary in the case of high frequency applications). For this reason, the electrical contact 80 has a narrow generally cup-shaped female contact element 31' which also receives the end-part of the sheathed conductor and which can be crimped to establish electric contact with said conductor. The electrical contact 70 is formed in a corresponding way. Thus, the contact 70 has a narrow, tubular central extension 90 of the cup-shaped part that receives the part 23. The extension 90 receives the non-bent end-part of the conductor 11 and can be crimped to establish electric contact therewith. The free end-part of the extension on contact 80 forms a female coupling element 31' that receives the male coupling element 32 on the contact 70. The extension includes a partition wall 81 that sealingly screens the passageway in the extension.

Figure 10:
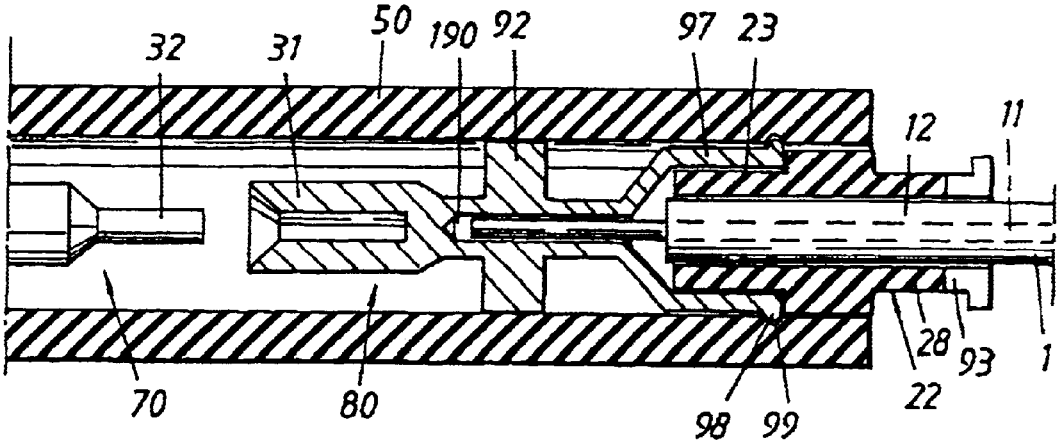
FIG. 10 illustrates a modification to the subject of FIG. 9.

FIG. 10 illustrates a variant of the FIG. 9 embodiment. The difference between the FIG. 9 and FIG. 10 embodiments is essentially that the body 22, which is made of a resilient plastic material, includes an outer part 28 that has a relatively thin wall and that has axially extending slots 93 at its outer end-part, which lies externally of the sleeve 50, so as to form means that relieve the cable 1 of flexural loads. Furthermore, the narrow passageway-part 190 of the contact 70/80, said part 190 receiving the naked end-section 11 of the conductor, has a thick-wall part 92. The part 92 is preferably integral with the coupling element 31 and may be comprised of the same material as the connector, for instance metal, such as brass, beryllium-bronze or a corresponding metal. The passageway 190 may, for instance, have a cross-sectional area of about 2.5 $mm^2$ and receive a conductor 11 of corresponding cross-sectional area (2.5 $mm^2$). Because of the larger wall thickness in the thick-wall part 92, it is possible to connect correctly a significantly narrower conductor 11 that has, for instance, a cross-sectional area of 1.5 $mm^2$ by crimping, in the same contacts.

In one embodiment, the ratio between the outer diameter and the inner diameter of the part 92 may be in the order of 2:1–6:1, preferably in the order of 3:1–5:1, said ratio preferably being roughly 4:1. Thus, owing to the wall thickness of said section, it is possible to achieve correctly a crimping connection to the electrical contacts even of relatively thin conductors 11.

The invention has been illustrated with reference to a sleeve that contains and sealingly bridges two electric contacts 70/80 which are coupled together in the interior of the sleeve 50. It will be understood, however, that the sleeve may, in principle, be formed by a coupling body which has passageways for receiving pairs of electric contacts 70/80. These passageways may be screened by a wall through which an electric contact extends, wherein the ends of the contact element are designed for co-action with the connection formation 31/32 of the contacts 70/80. The sealing closure of the passageway through the sleeve 50 can be established either by means of a circular bead 98 on the electric contact that engages with a corresponding circular groove 99 in the wall of the passageway through the sleeve 50, or by providing the body 22 with a circular bead that engages with a corresponding groove, or by fitting corresponding sealing rings.

When fitting an electric contact 70/80 to one end of a cable, an end-section of the wire 11 is bared and a body 22 is threaded onto the end of the cable. The bared wire 11 is then inserted into the passageway 21 and the sheathed part of the conductor/cable is inserted into the cupped end 97 of the electric contact together with the part 23 of the body 22. The wall of the contact is then crimped. The generally cup-shaped wall part 97 is crimped around the body part 23 and the end-part of the cable 1 located therein. The electric contact is then inserted into the sleeve 50.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A cable coupling device comprising:

a body having a through-passing, cable-receiving passageway therein for receiving a cable having a conductor therein;

an electric contact having a passageway-part and a generally cup-shaped part fitted over an end section of said body such that said passageway opens into said generally cup-shaped part, said passageway-part also opening into said generally cup-shaped part for receiving the conductor of said cable;

said passageway-part surrounded by a thick-wall part for crimping an inner wall of said passageway-part against said conductor for conductive connection therewith; and said body section being made of a resilient material at least in a crimping region thereof such that sealingly crimping said cup-shaped part of said electric contact around said body section causes a wall of said passageway to seal against an outer periphery of a cable inserted therein to prevent moisture from entering an interior of said cup-shaped part.

2. The cable coupling device as set forth in claim 1, wherein said thick-wall part is formed integrally with said electric contact and axially spaced from said cup-shaped part.

3. The cable coupling device as set forth in claim 1, further comprising a sleeve fitted over said body and said electric contact, wherein said cup-shaped part includes a circular bead on an outer rim that engages with a corresponding circular groove on an inner surface of said sleeve.

4. The cable coupling device as set forth in claim 1, wherein said passageway-part has a cross-sectional area of about 2.5 $mm^2$.

5. The cable coupling device as set forth in claim 1, wherein a ratio between an outer diameter of said thick wall part and an inner diameter of said passageway-part ranges from 2:1–6:1.

6. The cable coupling device as set forth in claim 5, wherein said ratio is approximately 4:1.

7. A cable coupling device comprising:

a body having a through-passing, cable-receiving passageway therein;

an electric contact having a passageway-part surrounded by a crimping portion, and a generally cup-shaped part fitted over an end section of said body such that said passageway opens into said generally cup-shaped part, said passageway-part also opening into said generally cup-shaped part for receiving a cable conductor; and said body section being made of a resilient material at least in a crimping region thereof such that sealingly crimping said cup-shaped part of said electric contact around said body section causes a wall of said passageway to seal against an outer periphery of a cable inserted therein to prevent moisture from entering an interior of said cup-shaped part;

said crimping portion axially spaced from said cup-shaped part for conductive connection to a naked conductor extending from said cable through said cup-shaped part and into said passageway-part.

8. The cable coupling device as set forth in claim 7, wherein said passageway-part has a cross-sectional area of about 2.5 $mm^2$.

9. The cable coupling device as set forth in claim 7, further comprising a sleeve fitted over said body and said electric contact, wherein said cup-shaped part includes a circular bead on an outer rim that engages with a corresponding circular groove on an inner surface of said sleeve.

10. The cable coupling device as set forth in claim 7, wherein said crimping portion has thick walls for correctly achieving a crimping connection with thin conductors, a ratio between an outer diameter of said crimping portion and an inner diameter of said passageway-part ranging from 2:1–6:1.

11. The cable coupling device as set forth in claim 10, wherein said ratio is approximately 4:1.

12. The cable coupling device as set forth in claim 10, wherein said passageway-part has a cross-sectional area of about 2.5 $mm^2$.

* * * * *